US011160322B2

(12) United States Patent
Plain

(10) Patent No.: US 11,160,322 B2
(45) Date of Patent: Nov. 2, 2021

(54) ANTI-CONCUSSIVE HELMET AND ALARM SYSTEM THEREFOR

(71) Applicant: John Plain, Park Ridge, NJ (US)

(72) Inventor: John Plain, Park Ridge, NJ (US)

( * ) Notice: Subject to any disclaimer, the term of this patent is extended or adjusted under 35 U.S.C. 154(b) by 191 days.

(21) Appl. No.: 15/968,008

(22) Filed: May 1, 2018

(65) Prior Publication Data

US 2018/0317590 A1 Nov. 8, 2018

Related U.S. Application Data

(60) Provisional application No. 62/602,721, filed on May 4, 2017.

(51) Int. Cl.

| | |
|---|---|
| ***A42B 3/12*** | (2006.01) |
| ***A42B 3/06*** | (2006.01) |
| ***A42B 3/04*** | (2006.01) |
| ***G08B 21/02*** | (2006.01) |
| *G08B 7/02* | (2006.01) |
| *G08B 7/06* | (2006.01) |

(52) U.S. Cl.

CPC ..... *A42B 3/122* (2013.01); *A42B 3/046* (2013.01); *A42B 3/0453* (2013.01); *A42B 3/064* (2013.01); *A42B 3/125* (2013.01); *G08B 21/02* (2013.01); *G08B 7/02* (2013.01); *G08B 7/06* (2013.01)

(58) Field of Classification Search

CPC ..... A42B 3/003; A42B 3/0486; A42B 3/063; A42B 3/064; A42B 3/067; A42B 3/068; A42B 3/069; A42B 3/121; A42B 3/122

See application file for complete search history.

(56) References Cited

U.S. PATENT DOCUMENTS

| | | | | |
|---|---|---|---|---|
| 4,223,409 | A * | 9/1980 | Lee | A42B 3/28 2/411 |
| 5,553,330 | A | 9/1996 | Carveth | |
| 5,956,777 | A | 9/1999 | Popovich | |
| 6,378,140 | B1 * | 4/2002 | Abraham | A42B 3/064 2/411 |
| 2007/0056081 | A1 * | 3/2007 | Aspray | A42B 3/067 2/411 |
| 2012/0233745 | A1 * | 9/2012 | Veazie | A42B 3/121 2/413 |
| 2012/0297526 | A1 | 11/2012 | Leon | |
| 2013/0174329 | A1 | 7/2013 | Hanson et al. | |
| 2013/0232668 | A1 * | 9/2013 | Suddaby | A42B 3/125 2/413 |
| 2013/0298316 | A1 | 11/2013 | Jacob | |
| 2014/0068841 | A1 * | 3/2014 | Brown | A42B 3/122 2/413 |
| 2014/0208486 | A1 | 7/2014 | Krueger | |
| 2014/0215694 | A1 * | 8/2014 | Grice | A42B 3/06 2/411 |

(Continued)

OTHER PUBLICATIONS

Jeremy Repanich: "Building a better helmet for a dangerous game", WIRED, Apr. 8, 2010.

*Primary Examiner* — Sally Haden

(74) *Attorney, Agent, or Firm* — Meagher Emanuel Laks Goldberg & Liao, LLP

(57) ABSTRACT

Various embodiments comprise systems, methods, architectures, mechanisms or apparatus for a helmet for reducing concussive injuries and an alarm system providing an indication of potential concussive impacts.

17 Claims, 6 Drawing Sheets

(56) References Cited

U.S. PATENT DOCUMENTS

| | | | | |
|---|---|---|---|---|
| 2015/0164172 | A1* | 6/2015 | Linares | A42B 3/0473 2/411 |
| 2015/0230534 | A1 | 8/2015 | McGuckin, Jr. | |
| 2016/0029730 | A1* | 2/2016 | Day | F16F 3/0873 2/412 |
| 2016/0029733 | A1 | 2/2016 | Kovarik et al. | |
| 2016/0040743 | A1* | 2/2016 | Staton | F41C 23/06 2/412 |
| 2017/0089416 | A1* | 3/2017 | Staton | B60J 1/2094 |
| 2017/0119080 | A1 | 5/2017 | Allen et al. | |
| 2017/0232327 | A1* | 8/2017 | Kuntz | A42B 3/125 2/413 |
| 2018/0035740 | A1 | 2/2018 | Knight | |
| 2020/0146385 | A1* | 5/2020 | Young | A42B 3/062 |

* cited by examiner

ANTI-CONCUSSIVE HELMET AND ALARM SYSTEM THEREFOR

CROSS REFERENCE TO RELATED APPLICATION

This application claims the benefit of the filing date of U.S. Provisional Patent Application No. 62/602,721 filed May 4, 2017, the disclosures of which are hereby incorporated herein by reference in their entireties.

FIELD OF THE DISCLOSURE

The present disclosure generally relates to a helmet for reducing concussive injuries and an alarm system providing an indication of potential concussive impacts.

BACKGROUND

The problem of concussive injury in the game of professional football has gained increasing attention in recent years as more and more former players have been found to be suffering from permanent and debilitating brain damage as a result of repeated high impact blows to the skull. This problem is not confined to the professional ranks, but manifests itself to an alarming degree among college, high school and youth league players due to the inherently violent nature of the game itself.

While a few changes to the rules of football have been proposed for the purpose of hopefully reducing the number of brain injuries experienced by players at all levels of the game, it is highly doubtful that such rules changes will eliminate concussive or sub-concussive events or even reduce such events to an "acceptable" level.

SUMMARY

Various deficiencies in the prior art are addressed by systems, methods, architectures, mechanisms or apparatus for a helmet for reducing concussive injuries and an alarm system providing an indication of potential concussive impacts. For example, various embodiments are directed to a helmet that can eliminate concussive injuries and, therefore, has the potential to be a great benefit to people in many and varied areas of life beyond sport at reducing and/or identifying the occurrence of serious and potentially debilitating head injuries.

One embodiment provides a helmet for dissipating impact energy and indicating the reception of impact energy associated with the predefined impact energy profile, comprising: a protective inner portion comprising a rigid shell formed as a single unit; a protective outer portion formed as a plurality of rigid shell segments and having a pneumatic impact absorber disposed thereon; each shell segment being operably coupled to a corresponding region of the protective inner portion by a respective plurality of spring assemblies mounted there between; each spring assembly comprising an elongated spring disposed within a sleeve, the sleeve configured to impart a substantially constant frictional force to the spring moving therethrough such that the spring assembly absorbs impact energy via compression of the elongated spring and friction between the elongated spring and sleeve; each spring assembly further comprising a switch configured to trigger a resettable alarm in response to compression of the elongated spring by an amount indicative of a threshold level of impact energy.

Additional embodiments provide that spring assemblies are configured to trigger an alarm in response to the threshold level of impact energy. For example, the spring assemblies may be configured to trigger an alarm in response to one of a plurality of predefined impact energy threshold levels, each impact energy threshold level being associated with a respective combination of spring coefficient of the respective elongated spring and friction coefficient of the respective sleeve within which the respective elongated spring is disposed. In various embodiments, at least one spring assembly associated with each shell segment is configured to indicate a level of impact energy sufficient to cause concussion.

BRIEF DESCRIPTION OF THE DRAWINGS

The teachings herein can be readily understood by considering the following detailed description in conjunction with the accompanying drawings, in which.

To facilitate understanding, identical reference numerals have been used, where possible, to designate identical elements that are common to the figures.

DETAILED DESCRIPTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Figure 1:
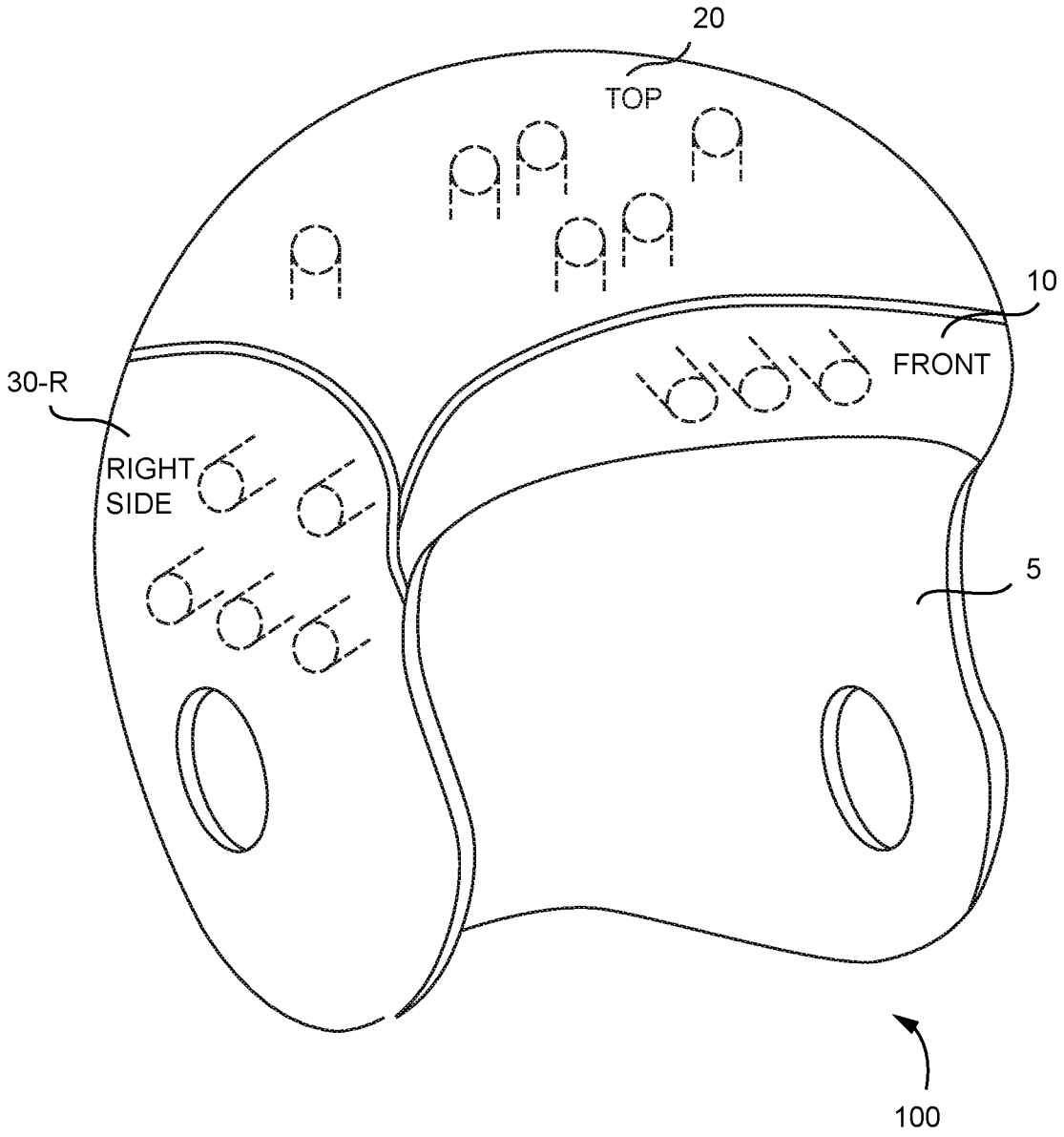
FIG. 1 depicts a helmet according to one embodiment.

FIG. 1 depicts a helmet according to one embodiment. Specifically, 1 depicts a helmet 100 such as a football helmet

100 comprising a protective inner helmet or inner helmet portion 5 formed as a single unit rigid shell (i.e., a shell encompassing the entirety of the protective inner portion 5). While not depicted in detail, the inner portion 5 may also include layers of padding and fabric and so on to provide additional support, protection and comfort to the wearer of helmet. The helmet 100 also includes a protective outer helmet or outer helmet portion formed as a plurality of rigid shell segments.

For example, FIG. 1 depicts a view of the helmet 100 showing a front segment 10, top segment 20 and right side segment 30-R. In addition, while not shown in the view of FIG. 1, the helmet 100 further includes a left side segment 30-L and a back segment 40. Each of the segments 10-40 is associated with a respective plurality of spring assemblies 50 mounted between the segment and the respective corresponding portion of the protective inner portion 5. The spring assemblies will be described in more detail below. Generally speaking, the spring assemblies comprise elongated springs confined within respective sleeves which assemblies are oriented in a manner suitable for receiving and absorbing impacts to the segment (i.e., normal to the plane of the segment). In various embodiments the elongated springs may be oriented in a manner that is not normal to the plane of the segments, such as to indicate glancing blows or impacts and the like to the helmet segment.

While generally described within the context of a football helmet, the teachings of the present embodiments may be readily modified to create helmets suitable for use in other types of activities, such as safety helmets for constructive workers, motorcycle riders, bicycle riders and so on. Any helmet may be improved in terms of avoiding/reducing concussive injury by modifying the helmet in accordance with the teachings herein.

A first embodiment is directed to a helmet configured to eliminate/reduce concussive injuries that utilizes both a "inner helmet" and "outer helmet" design. The inner helmet is designed to fit directly over a players skull in the same fashion as present helmets and is similar in shape, design and configuration to helmets currently in use. The outer helmet comprises a plurality of segments that fit tightly together to form, in essence, an outer helmet disposed about the inner helmet.

The various embodiments depicted herein five segments are used; namely, front, back, top, left side and right side segment. In other embodiments more or fewer segments may be used. The "illustratively" five segments of the outer helmet fit over the inner helmet with the interim surface of each segment attached to the exterior of the inner helmet by means of a plurality of spring assemblies, where each spring assembly comprises a spring an elongated spring within a sleeve such that the springs are able to move up and down inside of the sleeves when the outer helmet is involved in a collision/impact. While generally described within the context of round or cylindrical springs and slaves, it will be appreciated by those skilled in the art that springs of other shapes and configurations may also be utilized within the various embodiments.

Figure 5:
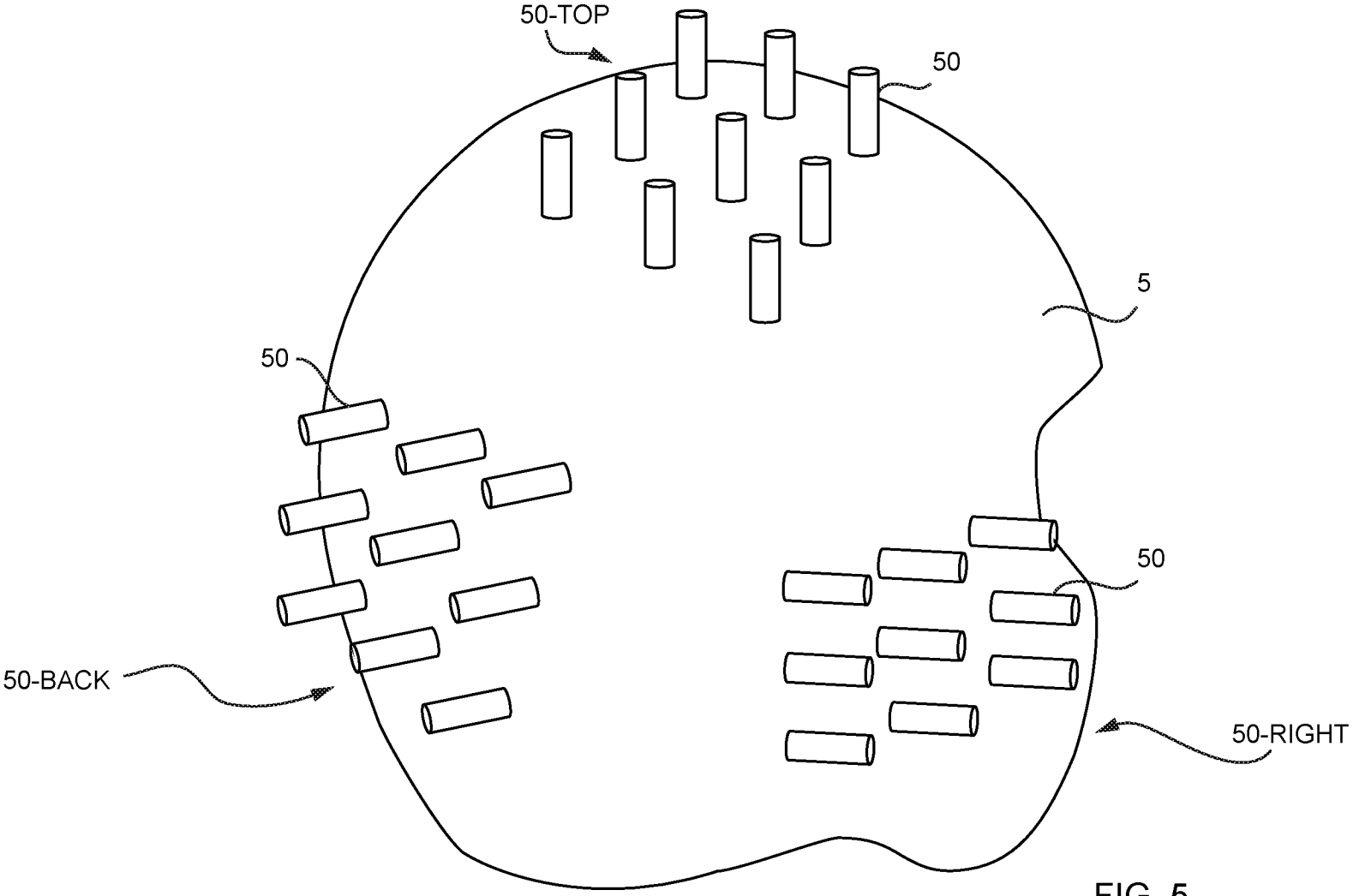
FIG. 5 depicts a portion of a helmet according to one embodiment.

FIG. 5 depicts a portion of a helmet according to one embodiment. In particular, FIG. 5 depicts an inner helmet 5 having mounted thereon a plurality of spring assemblies 50 disposed as a plurality of spring assembly groups operatively aligned with the various outer helmet portion springs; namely a top group 50-TOP, a back group 50-BACK and a right side group 50-RIGHT. While not shown in FIG. 5, it will be appreciated that additional spring assembly groups are associated with the left and front segments of the helmet. Thus, FIG. 5 visibly depicts 3×3 arrays of spring assemblies associated with each of the top, back and right segments, with similar 3×3 arrays of spring assemblies associated with the left and front segments (not shown).

Figure 6:
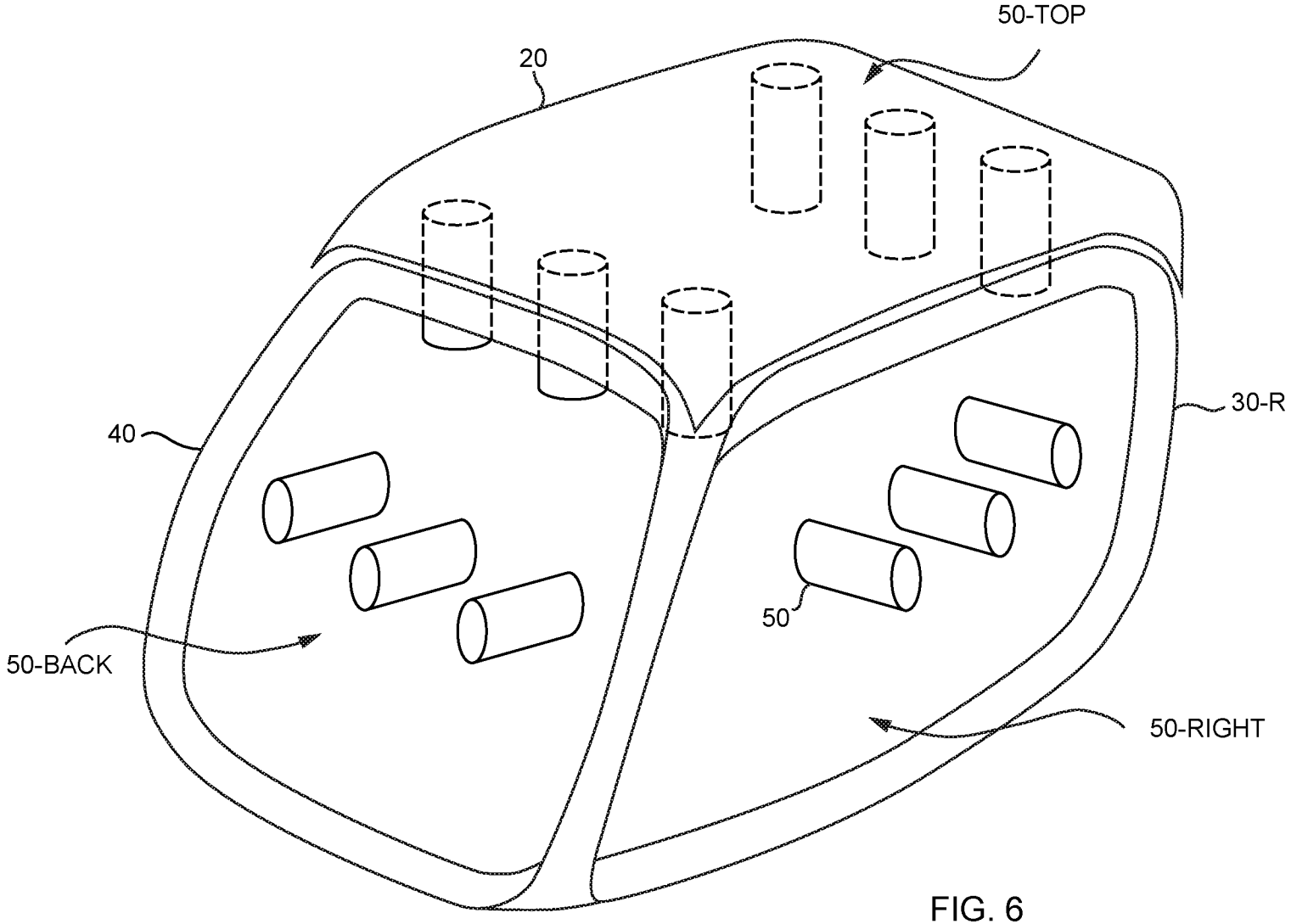
FIG. 6 depicts a helmet according to one embodiment.

FIG. 6 depicts a helmet according to one embodiment. In particular, FIG. 6 depicts the inner helmet portion and spring assembly groups of FIG. 5 mated with the outer portion segments; namely, the top segment 20 mated with the top spring assembly group 50-TOP, the right side segment 30-R mated with the rights side spring assembly group 50-RIGHT and the back segment 40 mated with the back spring assembly group 50-BACK.

Figure 2:
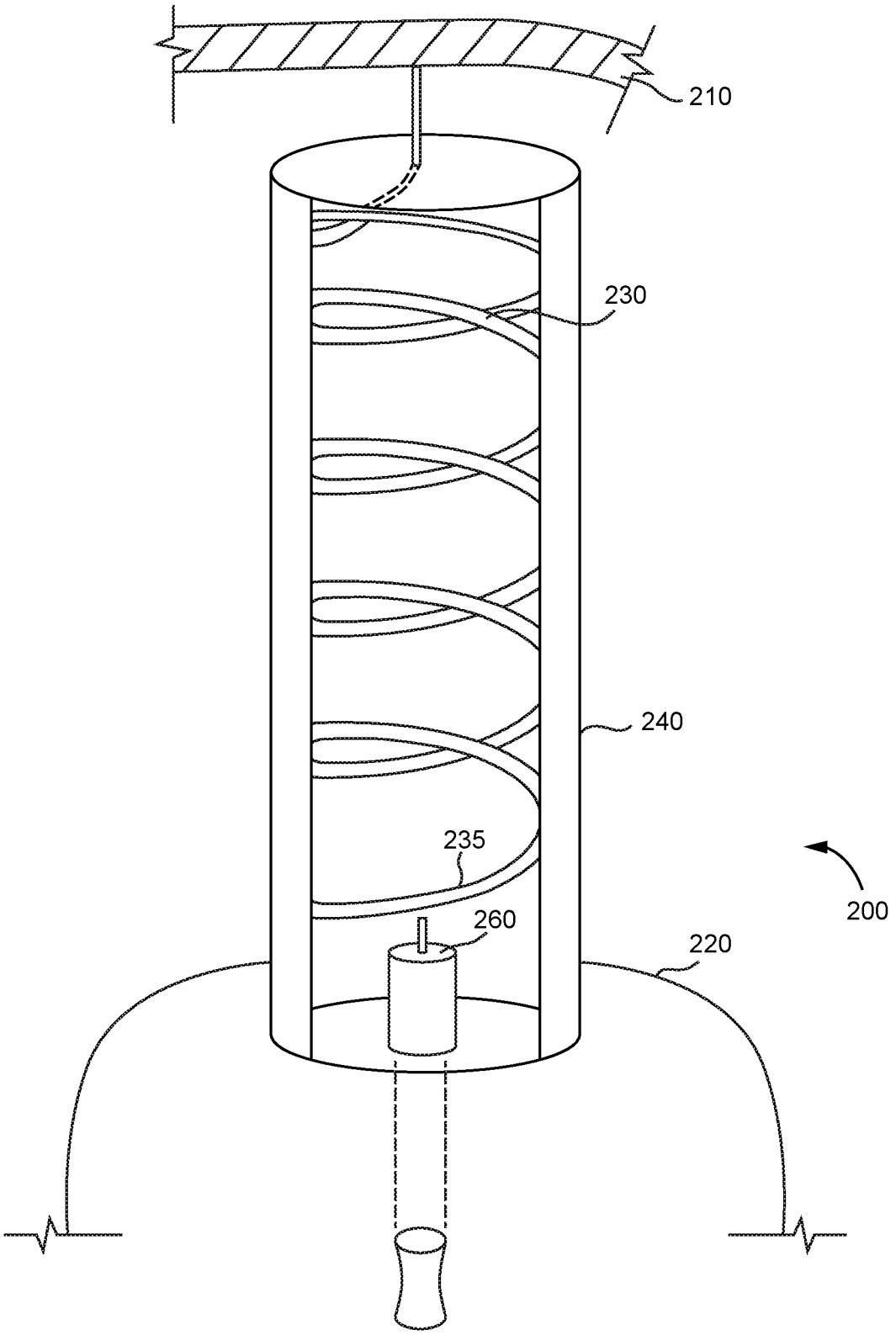
FIG. 2 depicts a spring assembly according to various embodiments.

FIG. 2 depicts a spring assembly according to various embodiments. Specifically, FIG. 2 depicts a spring assembly 200 comprising a spring 230 enclosed within a sleeve 240 and disposed between an inner surface 210 of an outer helmet segment and an outer surface 220 of the inner helmet. As depicted in FIG. 2, the spring assembly also includes a switch 260, wherein compression of the spring 230 urges the lower portion of the spring 235 into, and thereby activating, the switch 260. The switch may comprise an electrical switch, mechanical switch, electromechanical switch or any other type of switch suitable for generating a signal or completing a circuit or otherwise triggering an impact associated alarm as described herein.

As depicted in FIG. 2, the switch 260 will continue to indicate an alarm condition associated with an impact until such time as the switch is reset from inside of the helmets. That is, the switch 260 depicted in FIG. 2 is configured to be set or activated in response to an impingement or urging against the switch 260 by the spring 230 and remained set or activated until such and as a reset mechanism accessible from inside the helmet is engaged. In one embodiment, the switch is activated when spring is fully compressed and is turned off by pushing a rod through a hole on the underside of the inner helmet to force switch into an open position to thereby reset the switch.

While the switch 260 is depicted as mounted at the base of the spring and positioned in a manner to be activated upon displacement of the switch by a predetermined amount, and various other embodiments the spring may be mounted elsewhere within or proximate the spring assembly. Further, while the switch 260 is depicted as an electrical or mechanical switch, any type of switching technology may be used to indicate that a spring has been displaced by an impact-indicative amount.

The springs used with any spring assemblies comprise relatively stiff springs; that is, springs having high spring constants such that when one or more of the outer helmet segments receive an impact, the energy of that impact is transferred through pins joining the segment or segments to one or more spring assemblies being compressed by the impact such that the kinetic energy associated with the impact is at least partially absorbed by the one or more spring assemblies. In this way, the amount of destructive energy imparted to a players skull and brain is reduced and, hopefully, concussive injury is avoided.

The sleeves within which the springs of the spring assemblies are enclosed are fabricated from a material having a high coefficient of friction with respect to the springs themselves, and are fitted very tightly to the springs such that the outer surfaces of the springs are strongly urged against the inner surfaces of the sleeve. That is, the outer surfaces of the springs in contact with the inner surfaces of the respective sleeves rub against each other during compression or decompression (i.e., displacement) of the spring. The frictional forces imparted to the spring by the sleeve itself operate to absorb additional energy (as heat) associated with an impact causing spring compression, as well as to absorb energy associated with the rebounding of the spring after the impact. That is, the sleeve performs functions of guiding the springs such that compression of the spring occurs in a direction normal to the segment, and that the energy associated with compression of the spring due to the impact as well as the subsequent decompression of the spring after the impact is further dissipated as heat in overcoming the frictional force of the sleeve against the spring. Heat generated within the high friction sleeves may be vented through spaces in between the bottoms of the inner and outer helmet portions.

In various embodiments depicted herein, three or four spring assemblies are used per outer helmet segment. However, more or fewer spring assemblies may be used depending upon the application such as whether or not the helmet is for a child or an adult, the amount of impact energy to be indicated by compression of a spring, whether or not spring assemblies indicative of glancing blows are to be employed and various other factors as discussed herein. As such, the illustrative embodiments depicted herein are not to be construed as limiting in any way as to the number and/or type of spring assemblies to be used within the various embodiments.

Figure 4:
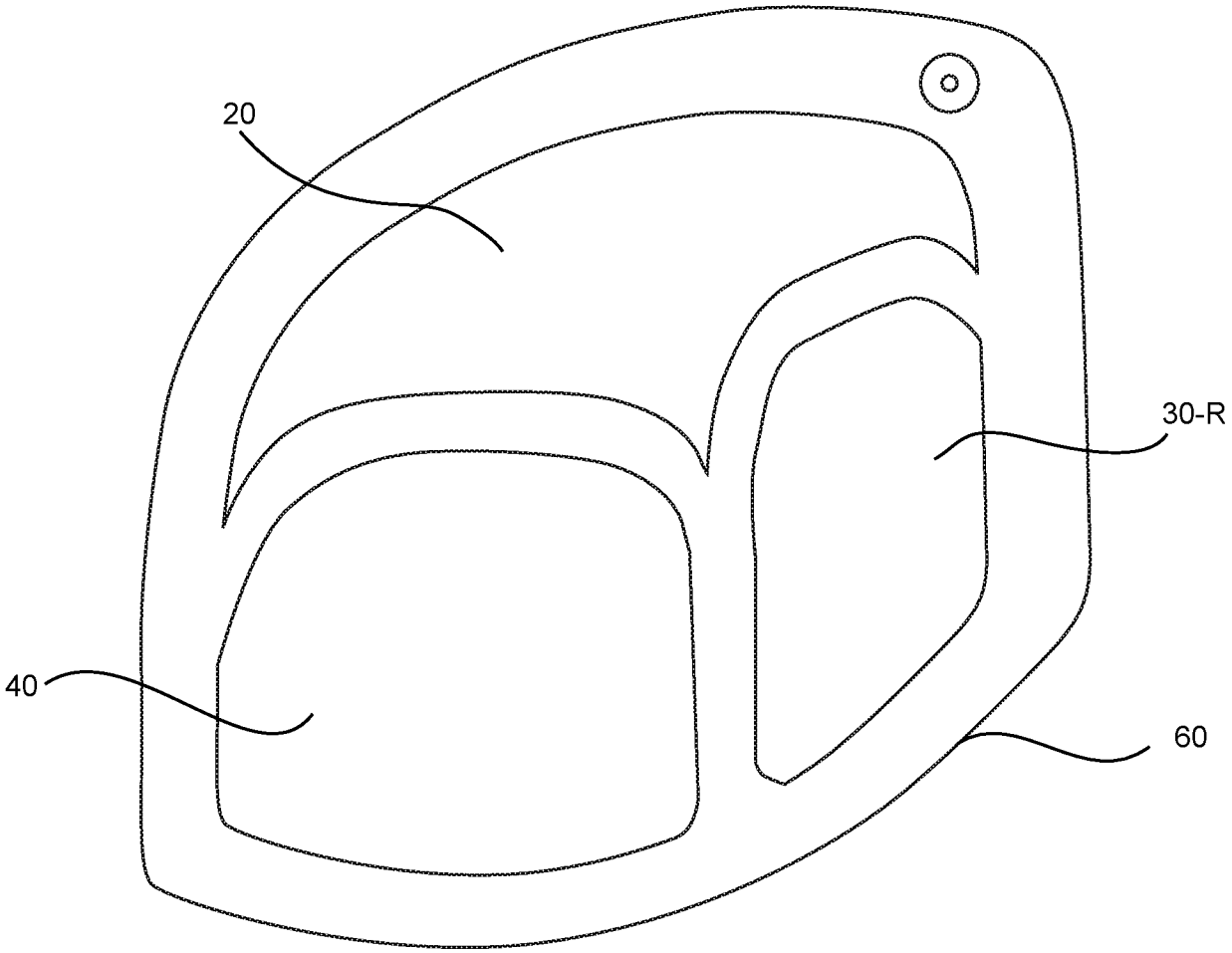
FIG. 4 depicts a helmet according to one embodiment.

FIG. 4 depicts a helmet according to one embodiment such as described above in FIG. 1, and further comprising an outer pneumatic impact absorber configured to substantially surrounded buffer the outer helmet. In particular, FIG. 4 depicts the top 20, right 30-R and back 40 segments as previously described with respect to the various embodiments. Further, the FIG. 4 depicts a pneumatic impact absorber 60 substantially surrounding the outer helmet portion including the various segments 10-40.

The pneumatic impact absorber comprises a resilient/flexible material inflated with an inert gas such as air or some other gas operative to provide an initial absorption of impacts to the helmet. The pneumatic impact absorber may comprise a single inflation chamber or multiple inflation chambers (e.g., multiple chambers having baffles therebetween to allow the flow of gas or air between chambers). The pneumatic impact absorber provides additional cushioning to the player wearing a helmet as well as other players that might come in contact with the helmet. The pneumatic impact absorber compresses and expands during and after impact, respectively. In various embodiments, the pneumatic impact absorber may be inflated via a tube either by mouth or with a pump.

A maximum protection version of the helmet depicted herein may comprise a multiple segmented outer helmet covered by a one or multiple chamber pneumatic impact absorber and connected to a unitary inner helmet via a plurality of spring assemblies at each of the multiple segments, where the spring assemblies provide shock absorption via stiff spring constant spring and via dissipation of impact energy as heat generated by the friction of spring surfaces rubbing against sleeve surfaces.

Concussive force impacts comprise those impacts having enough impact energy to cause a concussion by themselves. Dangerous force impacts comprises those impacts having enough impact energy to inflict some damage upon the brain. Various embodiments are configured to indicate that one or both of a concussive force impact and dangerous force impact have occurred.

In various embodiments, one or more of the spring assemblies associated with each segment is associated with a respective alarm mechanism which operates to indicate that a concussive force impact and/or dangerous force impact has occurred. The switch may comprise either an electrical switch or a mechanical switch triggered upon compression of a spring by a predetermined amount, where the predetermined amount is based upon the amount of impact force imparted to a segment and, particular, to the springs and was within that segment such that if a spring assembly has been compressed by the predetermined amount it is because the impact force to the segment was a concussive force or dangerous force.

The one or more spring assemblies used within a particular segment are formed using springs having a particular spring constant, which springs are enclosed within high friction coefficient sleeve. The spring constant of the spring in combination with the coefficient of friction of the sleeve define how much force is required to displace the spring by some predetermined amount. An electrical or mechanical switch proximate the base of the spring for example can be activated by compression of that spring such that an alarm indicative of the impact may be provided (e.g., visual alarm, audio alarm and the like).

Therefore, a particular spring having a particular spring constant enclosed within a sleeve having a particular coefficient of friction will, when fully displaced, the indicative of a specific and repeatable amount of impact energy. Multiple spring assemblies may be used such that the springs are not displaced until the amount of impact energy is equivalent to a concussive impact or a dangerous impact (or both). By using multiple spring assemblies the size of the springs use within the spring assemblies may be reduced.

In various embodiments, the length of the spring assemblies are kept within 2 inches or such other amount is deemed to be not interfering with respect to the activities performed while wearing the helmet. That is, the spring assemblies separate the inner and outer helmet by no more than 2 inches. Separation but a greater or lesser distance is contemplated in various embodiments but is limited and practicality by aesthetic considerations and other considerations such as not making the helmet so heavy that it is itself unpleasant to wear or stressful to the neck of the athlete.

Thus, it is contemplated that the various modifications to the above described embodiments are appropriate depending upon the type of helmet, thighs of helmet, concussive/dangerous forces, available materials and the like. For example, the number and location of spring assemblies to be used for each segment may vary depending upon the number of segments used, the stiffness of the springs used, the coefficient of friction of the sleeves and so on. Generally speaking, it is desirable to provide between two and eight spring assemblies per segment, where the individual spring/sleeve parameters are accordingly selected to fully compress (or otherwise trigger an alarm) in response to one half or one eighth of the total force indicative of a concussive/dangerous force. That is, it is assumed that the impact force received by a segments will be dissipated over the spring assemblies of that segment. Given the potential oblique angles of impact that may be experienced, various embodiments provide for "tuning" of spring assemblies such as via selectable pre-compression of springs and the like.

As an example, in various embodiments the spring assemblies are selected/calibrated such that an alarm is triggered in response to impact energy of a level sufficient to cause concussion. In other embodiments, the spring assemblies are selected/calibrated such that an alarm is triggered in response to impact energy of a level sufficient to contribute to subsequent concussions. Selection/calibration is performed with respect to spring constant, sleeve friction and the like.

In various embodiments, the switch is triggered upon full compression of the spring. If a segment has a single spring assembly, then that spring assembly is relatively stiff and large such that full compression of that spring assembly is approximately equal to, and therefor indicative of, an impact to the respective segment with an impact energy of a level sufficient to cause concussion or contribute to subsequent concussions. If a segment has a plurality (N) of spring assemblies, then each spring assembly is relatively less stiff and small such that full compression of a particular spring assembly is approximately equal to, and therefor indicative of, one Nth of an impact to the respective segment with an impact energy of a level sufficient to cause concussion or contribute to subsequent concussions. That is, using multiple spring assemblies allows for less stiff and smaller springs since the impact energy of the segment is distributed over the N springs such that each spring need only receive and indicate 1/N of the impact energy.

Thus, in various embodiments the helmet described herein provides additional protection to the wearer of the helmet due to the spring assemblies, pneumatic impact absorber and/or other features as described herein. In various embodiments, an audible alarm is provided when the helmet is subjected to an impact above a predefined level of force or energy. In such embodiments, the springs/spring assemblies may be calibrated in accordance with spring constants, coefficient of friction of the sleeve, tightness of the sleeve around the spring and so on such that an impact above the predetermined level results in a substantially full compression of the spring or springs closest to the point of impact.

In various embodiments, when the spring reaches maximum compression, the spring pushes down upon a switch directly, through a pivot arm, or via some other mechanical linkage to trigger the switch. For example, a pivot arm may be attached to a pivot post by means of a pivot pin, wherein the pivot arm is able to rotate around the pivot post in either a clockwise or a counter clockwise direction. When a spring pushes down on one end of its pivot arm, the pivot arm rotates in a one direction to thereby cause a ball at the other end of the pivot arm to wedge its way into two flanges which operate to hold the pivot arm via compression fit or a locking mechanism. Other mechanical linkages are also contemplated. In some embodiments, the pivot arm or other linkage completes a circuit between the flanges such that an audible and/or visual alarm indicative of the impact is generated. A reset mechanism dislodges the pivot arm from the flanges and disconnects the alarm circuit thereby. In various embodiments, a small hole is formed between each high friction sleeve and its adjoining pivot post such that a thin rod may be received therethrough to force the pivot arm back away from the flanges and reset the circuit thereby.

Figure 3:
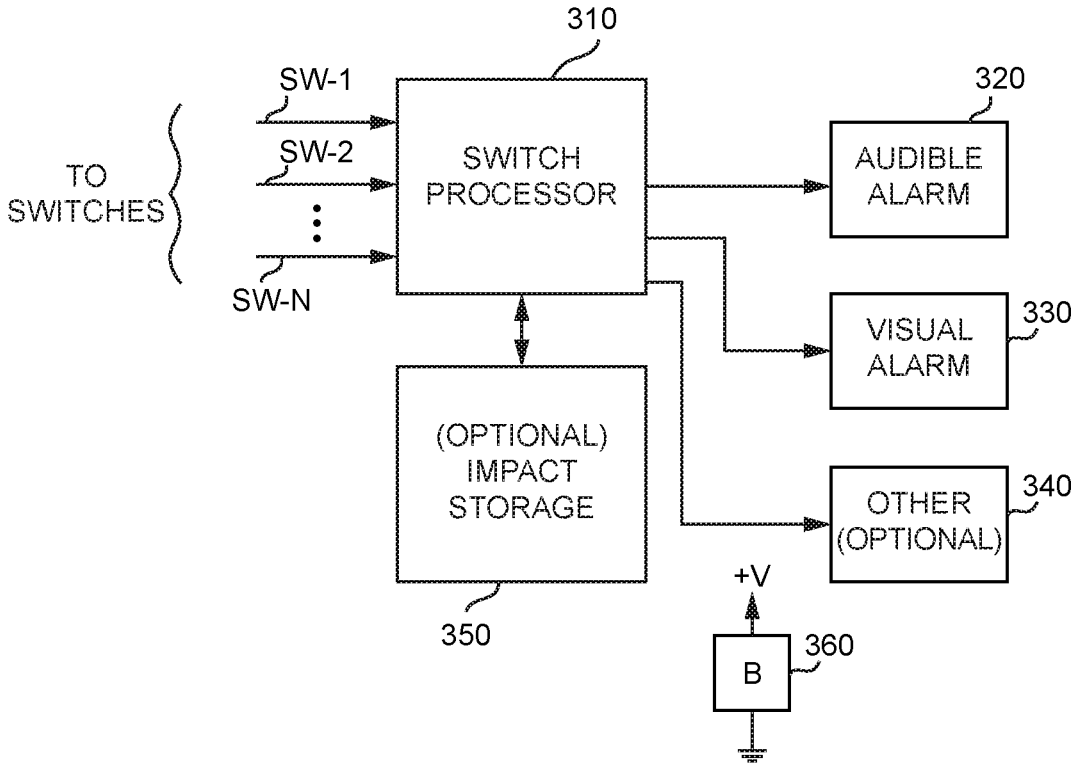
FIG. 3 depicts a high-level block diagram of alarm processing circuitry according to one embodiment.

FIG. 3 depicts a high-level block diagram of alarm processing circuitry 300 according to one embodiment. Specifically, FIG. 3 depicts a switch processor 310 receiving a plurality of switch signals SW-1, SW-2 and so on through SW-N (collectively switch signals SW) from respective spring assemblies 1-N. The switch processor 310 may comprise a simple switch matrix/decoder, a microprocessor-controlled switch processor or any other suitable device/configuration. The switch processor 310, in response to an indication of a switched or triggered spring assembly (i.e., a spring assembly having received a force sufficient to indicate either of a concussive or dangerous impact) triggers one or more of an audible alarm 320, a visual alarm 330 or some other alarm 340.

The audible alarm 320 may comprise any type of electrical or electro-mechanical audible alarm such as a bell or buzzer or similar device. The visual alarm may comprise any type of electrical or electro-mechanical visual alarm such as a light, color changing indicator (e.g., green to red colors in response to an alarm) or more device. The other alarm 340 may comprise any type of alarm indicator, such as a radiof-requency signal and the like to trigger a remote alarm. Optionally, an impact storage system 350 captures data from the switch processor 310 for further study.

In the case of the switch processor 310, alarms 320-340 or impact storage system 350 comprising an electrical or letter mechanical device requiring an energy source, a battery 360 is coupled to various component is appropriate within the context of the alarm processing circuitry 300.

Although various embodiments which incorporate the teachings of the present invention have been shown and described in detail herein, those skilled in the art can readily devise many other varied embodiments that still incorporate these teachings. Thus, while the foregoing is directed to various embodiments of the present invention, other and further embodiments of the invention may be devised without departing from the basic scope thereof.

What is claimed is:

1. A helmet for dissipating impact energy and indicating the reception of impact energy associated with the predefined impact energy profile; comprising:

a protective inner portion comprising a rigid shell formed as a single unit; and a protective outer portion formed as a plurality of rigid shell segments and having a pneumatic impact absorber disposed thereon;

each shell segment being operably coupled to a corresponding region of the protective inner portion by a respective plurality of spring assemblies mounted therebetween;

each spring assembly comprising an elongated spring disposed within a sleeve and contacting an inner wall of the sleeve, the elongated spring resisting a compressing force of an impact to the corresponding shell segment, the sleeve imparting a substantially constant frictional force to the elongated spring moving therethrough such that the spring assembly absorbs impact energy via compression of the elongated spring and friction between the elongated spring and sleeve;

each spring assembly further comprising a switch for triggering a resettable alarm in response to compression of the elongated spring by an amount indicative of a threshold level of impact energy.

2. The helmet of claim 1, wherein each of said plurality of spring assemblies triggers a respective resettable alarm in response to the threshold level of impact energy.

3. The helmet of claim 2, wherein each of said plurality of spring assemblies triggers the respective resettable alarm in response to one of a plurality of predefined impact energy threshold levels, each impact energy threshold level being associated with a respective combination of spring coefficient of the respective elongated spring and friction coefficient of the respective sleeve within which the respective elongated spring is disposed.

4. The helmet of claim 3, wherein at least one spring assembly, of the plurality of spring assemblies associated with each shell segment comprises an indicator to indicate a concussive force impact.

5. The helmet of claim 1, wherein the pneumatic impact absorber comprises a resilient material inflated with air.

6. The helmet of claim 5, wherein the pneumatic impact absorber comprises a plurality of chambers.

7. The helmet of claim 1, wherein the switch of each spring assembly comprises a mechanical switch and the helmet further comprises a battery and electrical circuitry operably coupled to the resettable alarms.

8. The helmet of claim 1, wherein the switch of each spring assembly comprises an electrical switch and the helmet further comprises a battery and electrical circuitry operably coupled to the electrical switch and resettable alarms.

9. The helmet of claim 1, wherein the plurality of rigid shell segments comprise a front segment, a top segment, a back segment, a right side segment and a left side segment.

10. The helmet of claim 1, wherein the threshold level of impact energy comprises a concussive force impact energy level.

11. The helmet of claim 10, wherein a full compression of at least one spring assembly of the plurality of spring assemblies associated with a segment is indicative of a concussive force impact of the segment.

12. The helmet of claim 10, wherein each of the spring assemblies associated with a segment fully compresses in response to a respective portion of the concussive force impact energy.

13. The helmet of claim 10, wherein a full compression of at least two spring assemblies of the plurality of spring assemblies associated with a segment is indicative of the concussive force impact of the segment.

14. The helmet of claim 10, wherein a full compression of at least two spring assemblies of the plurality of spring assemblies associated with a segment is indicative of the less than concussive force impact of the segment.

15. The helmet of claim 1, wherein the threshold level of impact energy comprises a less than concussive force impact energy.

16. The helmet of claim 15, wherein a full compression of at least one spring assembly of the plurality of spring assemblies associated with a segment is indicative of a less than concussive force impact of the segment.

17. The helmet of claim 15, each of the spring assemblies associated with a segment fully compresses in response to a respective portion of the less than concussive force impact energy.

* * * * *